US006869174B2

(12) United States Patent
Faken

(10) Patent No.: US 6,869,174 B2
(45) Date of Patent: Mar. 22, 2005

(54) INKJET PRINTER AND A METHOD OF PRINTING A RECEIVING MATERIAL

(75) Inventor: Henry Faken, Venlo (NL)

(73) Assignee: Océ-Technologies B.V., Venlo (NL)

( * ) Notice: Subject to any disclaimer, the term of this patent is extended or adjusted under 35 U.S.C. 154(b) by 0 days.

(21) Appl. No.: 10/133,316

(22) Filed: Apr. 29, 2002

(65) Prior Publication Data

US 2002/0180819 A1 Dec. 5, 2002

(30) Foreign Application Priority Data

May 21, 2001 (NL) ..... 1018114

(51) Int. Cl.[7] ..... B41J 2/01
(52) U.S. Cl. ..... 347/101; 347/103
(58) Field of Search ..... 347/104, 101, 347/99, 103, 88, 5, 14, 43; 101/491

(56) References Cited

U.S. PATENT DOCUMENTS 4,095,234 A 6/1978 Mito et al.
4,748,453 A 5/1988 Lin et al.
4,853,706 A 8/1989 Van Brimer et al.
4,965,593 A 10/1990 Hickman
5,141,599 A 8/1992 Jahn et al.
5,852,462 A * 12/1998 Lloyd et al. ..... 347/156
6,068,361 A 5/2000 Mantell
6,386,697 B1 * 5/2002 Yamamoto et al. ..... 347/103

FOREIGN PATENT DOCUMENTS

EP 0 863 480 A2 9/1998
EP 1 057 631 A1 12/2000
JP 2001-53943 2/2001
WO WO96-14989 5/1996

* cited by examiner

*Primary Examiner*—Stephen D. Meier
*Assistant Examiner*—Ly Tran
(74) *Attorney, Agent, or Firm*—Birch, Stewart, Kolasch & Birch LLP

(57) ABSTRACT

A printer and a method for printing a receiving material with such a printer, wherein the printer is provided with a printhead with a number of print elements from which individual ink drops can be transferred to a receiving material in accordance with a pattern, wherein the printer uses hot melt ink and also contains a selection means for the selection for a specific degree of gloss based on the selection of the pattern to be generated, which pattern is such that the ink acquires the said degree of gloss on the receiving material.

8 Claims, 4 Drawing Sheets

| | |
|---|---|
| 1 | L1 |
| 4 | L2 |
| 3 | L3 |
| 2 | L4 |
| C1 | |

FIG. 2

| | | |
|---|---|---|
| 1 | 5 | L1 |
| 8 | 4 | L2 |
| 3 | 7 | L3 |
| 6 | 2 | L4 |
| C1 | C2 | |

FIG. 3

| | | | | |
|---|---|---|---|---|
| 1 | 13 | 3 | 15 | L1 |
| 9 | 5 | 11 | 7 | L2 |
| 2 | 14 | 4 | 16 | L3 |
| 10 | 6 | 12 | 8 | L4 |
| C1 | C2 | C3 | C4 | |

FIG. 4

INKJET PRINTER AND A METHOD OF PRINTING A RECEIVING MATERIAL

BACKGROUND OF THE INVENTION

Field of the Invention

The present invention relates to a printer provided with a printhead with a number of print elements from which individual ink drops can be transferred to a receiving material in accordance with a pattern. The present invention also relates to a method of printing a receiving material with ink.

A printer of this kind, also termed an inkjet printer, is known from U.S. Pat. No. 4,748,453. This patent specification describes an inkjet printer having a number of printheads, namely one printhead for each of the colors yellow, cyan, magenta and black, each head being provided with a row of print elements. Each print element can be individually actuated and is adapted to eject (jet) a single drops of ink. The four printheads are combined on a support member termed a carriage. To print the receiving material, the carriage is moved in a number of passes with respect to the receiving material in a main and a subscanning direction, with ink drops being simultaneously jetted from the print elements in the direction of the receiving material. In this way it is possible to build up an image from individual ink drops on the receiving material. The jetting of the ink drops takes place using a predetermined print mask. This means that the ink drops are transferred to the receiving material in accordance with a predetermined pattern. This pattern is the strategy or the canvas on which the images for printing are filled in with individual ink drops. The patent specification uses a chessboard pattern, in which at least two print passes are necessary to print a full line in a main scanning direction. This pattern, which in the known printer is stored in the printer memory, is used to obtain a uniform color impression over the surface of the receiving material with a specific type thereof, namely a transparent overhead film. Using the described pattern there is no overlap between the ink drops printed next to one another, at least as long as the drops are still liquid. This prevents ink drops from running into one another, so that a uniform color impression is always obtained.

A printer of this kind is also known from U.S. Pat. No. 4,965,593. This printer also makes use of a print mask in which the pattern is such that no pixels are printed next to one another in the same pass of the print head. This prevents the ink drops from running together and hence the colors from running together.

A significant disadvantage of the known printers is that the degree of gloss of the ink on the printed receiving material depends very much on the type of receiving material used. When a normal type of paper (plain paper) is used, a matt print will usually form. To obtain a glossy print it is necessary to select a different type of receiving material, for example a glossy paper such as is known from U.S. Pat. No. 5,141,599. A special receiving material of this kind is very expensive. Another disadvantage is found in printing reports which contain both black and white information and color information. The black and white information, usually text, is preferably printed matt in order to have a positive influence on legibility. Frequently, pages which contain only text information are printed by conventional electrophotography on plain paper. To maximise the color space and obtain sufficient sharpness, the color information, for example graphics or photographic images, is preferably printed in high gloss, often on the above-mentioned glossy paper. The result is that such reports contain two distinctly different receiving materials, and this is fairly disturbing to the reader.

The above-described problem is also disturbing to the user of the known printers. Whenever he wishes to change from a glossy print to a matt print, he must give the inkjet printer a different receiving material. This takes time and often leads to damage or soiling of the receiving materials. In addition, the unsuspecting user, who frequently sends his information to the printer from a workstation, will usually not check beforehand what type of receiving material is present in the printer. This can have the result that the information is printed on a type of receiving material which is not his choice, and this is not noticed until the printing has taken place.

U.S. Pat. No. 4,095,234 and U.S. Pat. No. 4,853,706 also disclose printers in which a high gloss of the printed ink can be obtained independent of the receiving material being used. In both printers, the printed receiving material is subjected to after-treatment so that the ink will have a greater gloss. U.S. Pat. No. 4,095,234 discloses after-treatment with a gloss agent, which agent is selectively deposited on the printed ink drops. U.S. Pat. No. 4,853,706 discloses a thermal/mechanical after-treatment in which the ink drops are so flattened that they form a substantially flat surface so that refraction and scatter of light is minimized. Both the known printers have the disadvantage that they must be equipped with an after-treatment station. Such stations make the printers expensive and the use thereof is accompanied by a relatively considerable energy consumption.

SUMMARY OF THE INVENTION

It is an object of the present invention to obtain an inkjet printer and associated method in which the gloss of the ink on the receiving material can be pre-set irrespective of the receiving material used and without it being necessary to make use of an after-treatment of the printed receiving material. For this purpose an inkjet printer has been developed wherein the printer uses hot melt ink and also contains a selection means for selecting a specific degree of gloss, on the basis of which selection a pattern can be generated, in which pattern the ink acquires the said degree of gloss on the receiving material.

In addition a method has been developed for printing a receiving material with ink which comprises pre-selecting the degree of gloss which the ink is required to acquire on the receiving material, generating a print pattern on the basis of the selected degree of gloss, the printing of hot melt ink being conducted by a printer provided with a printhead having a number of print elements, wherein the individual ink drops are jetted from the print elements and transferred to the receiving material in accordance with the said pattern, whereafter the ink solidifies on the receiving material and acquires the selected degree of gloss.

It has been found that the objective of the present invention is achieved by the combination of hot melt ink and a specific pattern. The present invention is based on the realization that the solidification of an individual drop of hot melt ink on the receiving material is virtually independent of the type of receiving material, but that such solidification is greatly influenced by the possible presence of still liquid drops of hot melt ink in the vicinity of the solidifying drop. In other words, the way in which the individual ink drops are distributed on the receiving material, which is determined by the pattern being used, has a significant influence on the solidification behavior of each of the ink drops. Further investigation has then shown that the way in which a hot melt ink drop solidifies in turn determines the degree of gloss of the solidified ink drop. Thus it will be seen that by using both hot melt ink and a specific pattern it is possible to preset the gloss of the ink on the receiving material. The degree of gloss of the ink is, in this way, virtually independent of the receiving material used and can be set between very matt and very glossy without it being necessary to use an after-treatment of the printed receiving material.

A number of different degrees of gloss can be selected with a selecting means, for example "high gloss", "silk gloss" and "matt". The selection initiates the generation of a pattern which, in combination with the hot melt ink, will result in the selected degree of gloss for the ink.

It should be noted that it is immaterial to the present invention how the pattern is generated. In one embodiment, a number of patterns are stored in the printer, or in a remote controller, or anywhere, and by the selection of a specific degree of gloss one of said patterns is retrieved from the memory and used for printing the receiving material. It is also possible for the printer to actively generate the pattern after a selection has been made for a specific degree of gloss, for example, by the use of an algorithm coupled to said selection. This latter embodiment has the advantage that it is more flexible than the former.

The type of selection means for selecting a specific degree of gloss does not form part of the present invention. It may be a hardware knob (or a plurality of such knobs), for example a rotary knob, a pull knob, a press button, a sliding switch, a tumbler switch, a joystick type switch, a touch screen, and the like. A means of this kind can naturally also be embodied in some other way, for example as software, so that it is possible inter alia to select a "gloss" option in defining a print job from a decentralised workstation, that can be carried out by means of a mouse and icon, text or other options. It would also be possible for the printer, which can include remote components such as a controller or a workstation, to react to sound, e.g. the voice, or any excitation (optical, mechanical, direct, indirect). Other options, for example, are codes on a receiving material which are recognised by the printer and result in a specific pattern for the printing, or for example codes which are transmitted together with a print order depending on the location where the order is generated, and so on.

In one embodiment of the printer according to the present invention, the selection of a specific degree of gloss can be made by a user of the printer. This embodiment has the advantage that a high degree of flexibility is obtained so that the printer is very user-friendly. Prior to each print job, the user can select the degree of gloss and adjust it to the result required at that particular time. If the printer can be operated from a workstation, the degree of gloss can preferably also be selected from the workstation. This is possible for example by means of one or more icons on the VDU at the workstation or elsewhere, for example by means of a selection that can be set during the defining of the print job.

In an alternative embodiment, the selection can be made automatically by the inkjet printer on the basis of an adjustable criterion. In this embodiment, it is the printer itself that selects a specific print mask and hence a specific print gloss. The printer makes this selection on the basis of a specific criterion which is adjustable, i.e., for example, a different criterion can be selected or the criterion itself can be amended (for example a threshold value changed). In this way the printer is nevertheless sufficiently flexible. The construction according to this embodiment may be advantageous in environments which are highly standardised but must nevertheless have the freedom for the standards to be changed. This embodiment can also promote user convenience. If, for example, it is known that a specific setting is always selected for a glossy print, then it is convenient for the user for the glossy print to be selected automatically when he selects the relevant setting. In this embodiment too a default selection can be set and adapted to the type of gloss most frequently requested.

In a preferred form of this alternative embodiment, the criterion is selected from any of the type of receiving material, the type of hot melt ink, the type of information to be printed, the user, the maximum printing time, etc. For example it is possible that if a specific type of receiving material is selected in the setting of a print job, for example colored paper or plain paper, the users always want a matt print. In that case, this selection can be made automatically by the printer itself. The printer could also be equipped, for example, with a sensor to measure what type of receiving material is being printed. If the receiving material is an overhead film, for example, then a high-gloss print can automatically be selected (because this scatters less light). Even if a specific type of hot melt ink is selected, for example a "Gold Brand" ink, which is intended especially for high-gloss prints, it would be convenient if the corresponding selection for a high-gloss print were made automatically so that such expensive ink is not wasted on matt prints. The automatic selection can also be coordinated with the type of information being printed. In the case of informational text, the choice could be made, for example, for matt printing, while for a photographic image (for example on the same page) high-gloss printing would automatically be selected. It may also happen that a specific user always wants a silky gloss print. For a user of this kind it would be convenient for this type of gloss to be set automatically. The maximum printing time may be another criterion. Since each print mask involves a different printing time, the selection of a specific maximum printing time may conflict with a convenient selection of a specific degree of gloss. Here too an automatic selection would be advantageous.

In a preferred embodiment of the printer, the automatic selection of a print mask can be cancelled by the user himself. In this embodiment the user has maximum flexibility because he can, at any time, cancel the printer selection and himself determine what degree of gloss he wants for the ink on the receiving material for printing. In this embodiment, the selection as made by the printer is indicated on the printer or at the workstation, for example on a monitor, so that the user has the opportunity of cancelling this selection and himself making an alternative selection or allowing the printer to make a new selection on the basis of a different criterion.

In both embodiments of the present invention, i.e. the embodiment in which the user selects the degree of gloss and the embodiment in which the printer automatically selects the degree of gloss, it is possible to vary the selected degree of gloss over the receiving materials being printed. Thus it is possible in the case of the "high gloss" selection, to print just the color information in high gloss and the (black and white) text information in a matt or silk gloss. There can also be a distribution over the receiving material for printing, depending on the location (for example the cover sheet or report title always in high gloss, irrespective of the selection of the degree of gloss for the rest of the information in the report). Such distributions would be selected by the user but it is of course also possible to fix such distributions by means of automatic settings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 shows a pattern for a high-gloss print result;

FIG. 3 shows a pattern for a silk-gloss print result;

FIG. 4 shows a pattern for a matt print result;

DETAILED DESCRIPTION OF THE INVENTION

Figure 1:
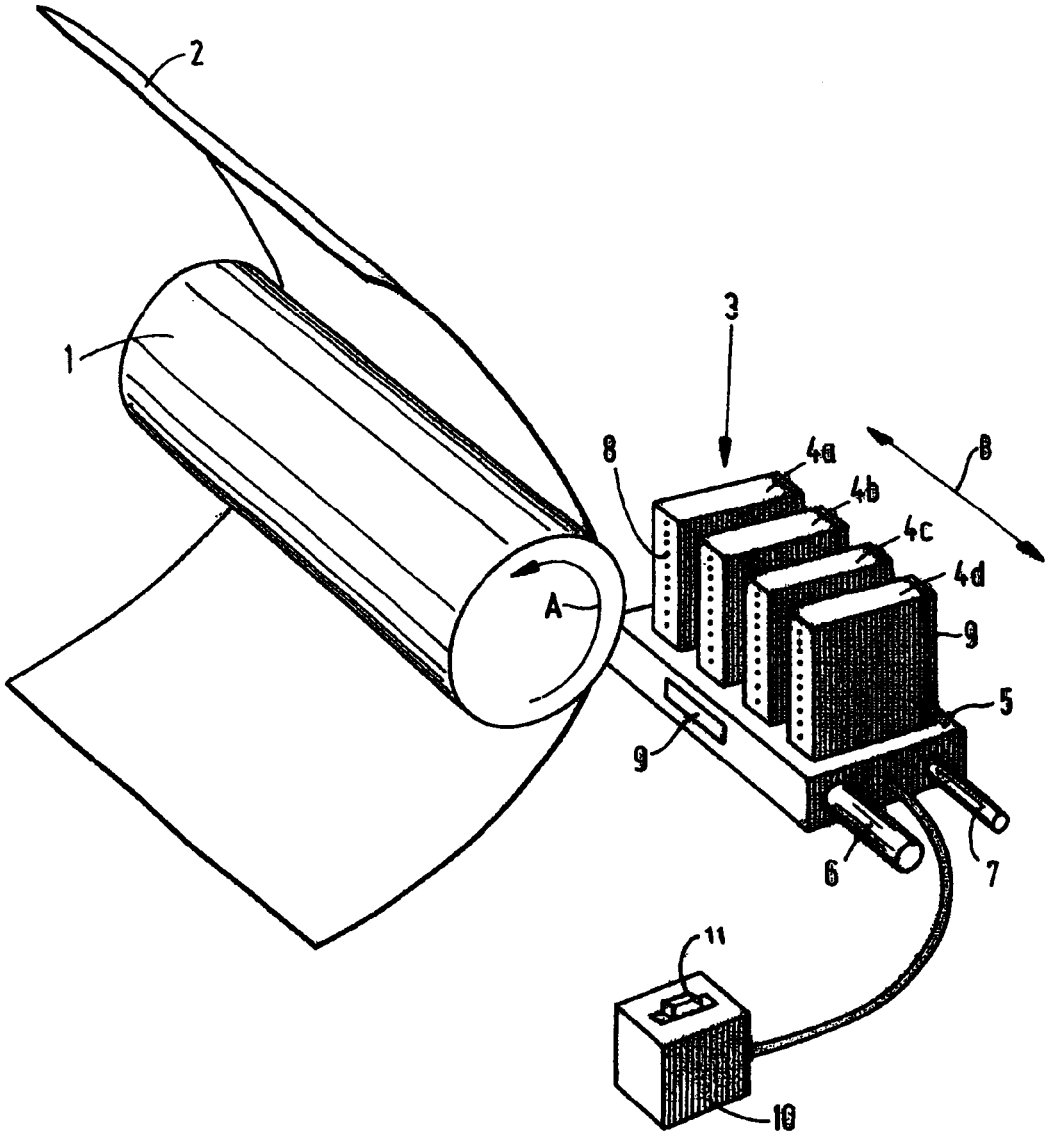
FIG. 1 diagrammatically illustrates an inkjet printer.

FIG. 1 diagrammatically illustrates an inkjet printer. In this embodiment, the printer comprises a roller 1 for supporting a receiving material 2, for example a sheet of paper or a transparent sheet, which moves along the scanning carriage 3. This carriage comprises a support member 5 on which the four printheads 4*a*, 4*b*, 4*c* and 4*d* are fixed. Each printhead is provided with an ink of its own color, in this case cyan (C), magenta (M), yellow (Y) and black (K), respectively. The printheads are heated by heating means 9 disposed at the back of each printhead 4 and on the support member 5. These heating means ensure that the temperature of the printheads is higher than the melting temperature of the hot melt ink so that the latter can be present in the liquid state in the printheads. Temperature sensors (not shown) are also provided on the carriage. The printheads are maintained at the correct temperature via a control unit 10, by means of which the heating means can be individually actuated depending on the temperature measured by the sensors.

The roller 1 is rotatable about its axis as indicated by arrow A. In this way, the receiving material can be moved in the sub-scanning direction (X-direction) with respect to the support member 5 and hence also with respect to the printheads 4. The carriage 3 can be moved in reciprocation by suitable drive means (not shown) in a direction indicated by the double arrow B, parallel to the roller 1. For this purpose, the support member 5 is moved over the guide rods 6 and 7. This direction is termed the main scanning direction or Y-direction. In this way the receiving material can be completely scanned with the printheads 4. In the embodiment as shown in the Figure, each printhead 4 comprises a number of print elements each provided with an ink duct (not shown) with its own nozzle 8. In this embodiment, the nozzles form for each printhead one row which extends perpendicularly to the axis of roller 1 (sub-scanning direction). In a practical embodiment of an inkjet printer, the number of ink ducts per printhead will be many times larger and the nozzles distributed over two or more rows. Each ink duct is provided with means (not shown) whereby the pressure in the ink duct can be suddenly increased so that an ink drop is ejected through the nozzle of the associated duct in the direction of the receiving material. A means of this kind can be, for example, a thermistor or a piezo-electric element. These means can be energised image-wise via an associated electric drive circuit (not shown). In this way an image built up from ink drops can be formed on receiving material 2.

When a receiving material is printed with a printer of this kind, wherein ink drops are ejected by the print elements, the receiving material or a part thereof is (imaginarily) divided up into fixed locations which form a regular field of pixel rows and pixel columns. In one embodiment, the pixel rows are perpendicular to the pixel columns. The resulting separate locations can each be provided with one or more ink drops. The number of locations per unit length in the directions parallel to the pixel rows and pixel columns is termed the resolution of the printed image, for example as indicated by 400×600 d.p.i. ("dots per inch"). By actuating a row of nozzles of a printhead of the inkjet printer image-wise when the row moves with respect to the receiving material with displacement of the support member 5, a (part-) image built up from ink drops forms on the receiving material, at least on a strip of a width of the length of the nozzle row. In this embodiment, control unit 10 is also provided with a sliding knob 11 by means of which a user of the inkjet printer can select the required degree of gloss. On the basis of this choice the field is printed using a pattern corresponding to this degree of gloss.

FIG. 2 shows a pattern for obtaining an ink, which when solidified on a receiving material, has a high gloss, substantially independent of the medium used. It can generally be stated that a glossy print is obtained by selecting a pattern in which the individual ink drops are, as far as possible, jetted directly next to one another on the receiving material. Since the ink drops are still liquid shortly after they have been transferred to the receiving material, they will flow together at the points of contact. This results in a surface structure which is substantially smooth. A surface structure of this kind scarcely scatters the light but has a more specular character, so that the impression of a high-gloss print is obtained. It should be noted that the receiving medium used always has a minor influence on the final degree of gloss of the print. Of course a highly reflective background with one and the same ink coverage automatically gives a more glossy character to the ink, for the simple reason that the background reflects more light to the person viewing the print. Also, the gloss of the ink itself (there are highly glossy ink formulations but also more matt ink formulations) will also influence the final overall impression.

Numerous patterns (print masks) can be devised by means of which a glossy print can be obtained. Whether a specific pattern is suitable depends, inter alia, on the type of inkjet printer, the ink itself, the image that is printed, and also the resolution of the row of print elements with respect to the required print resolution.

In this example, a pattern is given by means of which printing is possible in a high gloss with a printer in which the row of print elements has a resolution (or "nozzle pitch" in this context) which is four times smaller than the required print resolution in the direction parallel to the row of print elements (termed print resolution in this context). This means that in one pass of the inkjet printhead, only one image row (a row parallel to the main scanning direction) of each four image rows can be printed. FIG. 1 diagrammatically shows the first column (C1) of four image rows (L1, L2, L3, L4).

In this example, for simplification purposes, it is assumed that the receiving material is provided with a solid ink surface. This means that in this surface each drop is completely surrounded by other drops. In a practical situation, solid surfaces will never be printed alone, but there will practically always be parts of solid surfaces up to even single pixels. In these cases too, however, the same pattern is used but not all the pixels on the receiving material are provided with an ink drop. To illustrate the invention, however, the said solid surface will be taken as a basis.

At the respective points (C1, L1), (C1, L2), (C1, L3), and (C1, L4) of the pattern there is an indication of that pass of the printhead in which the corresponding pixel is provided with an ink drop. In this case we see that the pixel corresponding to the first column (C1) and the first row (L1) is printed in pass 1, the pixel corresponding to the first column (C1) and the second row (L2) is printed in pass 2, and so on. The other pixels in the rows corresponding to L1 to L4 (not shown) are printed with a repetition of this pattern (repetition in the main scanning direction). This means that when this mask is used, all the pixels in the first row (corresponding to L1 of the mask) are provided with an ink drop in the first pass of the printhead. Since the drops are printed immediately next to one another, they will flow into one another. According to this mask, the fourth row (L4) is printed with ink drops in the second print pass (for example the printhead return pass). In the third pass, the third row (L3) is provided with ink drops, and finally the second row (L2) is provided with ink drops in the fourth pass. In order to print the following rows, i.e. the rows above or below the rows illustrated, this pattern is repeated at the corresponding places (repetition in the subscanning direction).

It will be apparent that when this pattern is used the ink drops have sufficient time to flow together in order thus to form a substantially flat reflecting surface which gives the impression of a high-gloss print.

FIG. 3 gives a pattern for the same printhead and required print resolution as in Example 2, i.e. with a nozzle pitch/print resolution ratio of 1/4. This pattern gives a silky gloss print.

In this pattern, the pixel corresponding to the location (C1, L1) of the given mask is printed in the first pass of the printhead and the following pixels in the same row, which as illustrated corresponds to the location (C2, L1) of the mask, is printed in the fifth pass. The rest of the pixels in this first row are printed in accordance with a repetition of this pattern, i.e. all the odd pixels in the first pass, all the even pixels in the fifth pass. For the second row (L2) all the odd pixels are printed in the eighth pass of the printhead and all the even pixels in the fourth pass of the printhead. For the third row (L3), all the odd pixels are printed in the third pass and all the even pixels in the seventh pass. Finally, for the fourth row (L4) all the odd pixels are printed in the sixth pass and all the even pixels in the second pass. The following rows (L5 and so on, not shown) are then printed in accordance with a repetition of this pattern. It will be apparent that due to the longer time prevailing between the printing of adjoining ink drops (on average something more than three passes) a reduced degree of running together results so that the resulting structure of solidified ink drops has a surface with a somewhat rougher character. More precisely, it can be stated that in this example there is at least one pass between adjoining ink drops (so that the drops will solidify to some extent in the interim). In the case of the ink in this example, the drops which can still run together are usually printed obliquely with respect to one another. This means that running together is made even more difficult since the contact surface between these drops is smaller than in the case of the drops in FIG. 2. This results in a solidified ink which has a silky gloss character. The degree to which the ink drops run into one another depends not only on the print mask but also, for example, on the type of ink (quick or slow drying), the type of receiving material (smooth or fibrous), the temperature of the receiving material and the ink, the length of the contact surface between the drops (contact point or contact line), the drying time between the placing of neighboring drops, and so on. By taking each of the relevant parameters into account it is possible to adjust how many passes there may be between the placing of two neighboring drops (in the main or subscanning direction or diagonally) depending on whether they are to run together or not.

FIG. 4 gives a pattern for the same printhead and required print resolution as in Example 2, i.e. with a nozzle pitch/print resolution ratio of 1/4. This pattern results in a matt print.

In this pattern, a surface of 16 pixels is filled in 16 passes of the printhead as shown in the drawing. In this pattern, there is, on average, a somewhat longer wait (almost six passes) before one ink drop is placed next to another ink drop. As a result, the individual ink drops have even more chance of solidifying before they touch one another so that the resulting structure of the printed ink layer corresponds substantially to a structure of individual hemispherical ink drops. As a result of the relatively considerable light scatter, this gives the impression of a matt print.

Figure 5:
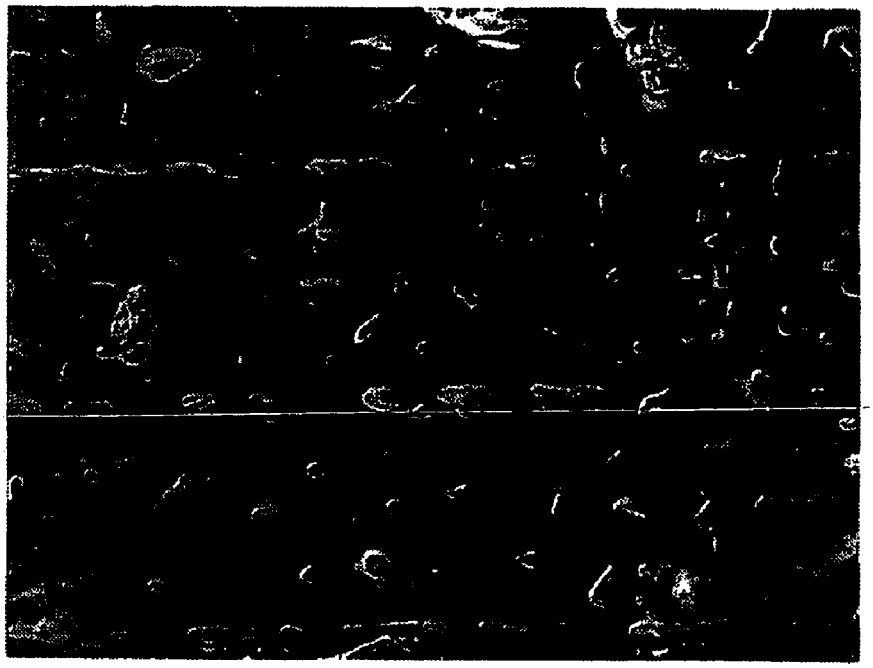
FIG. 5 is a micrograph of a receiving material printed with a hot melt ink solid surface using the pattern shown in FIG. 2.

FIG. 5 is a micrograph of a receiving material printed with a hot melt ink solid surface using the pattern given in FIG. 2. It is clear that there are now practically no individual ink drops visible. This means that the ink drops have largely run together and have formed a uniform glossy surface.

Figure 6:
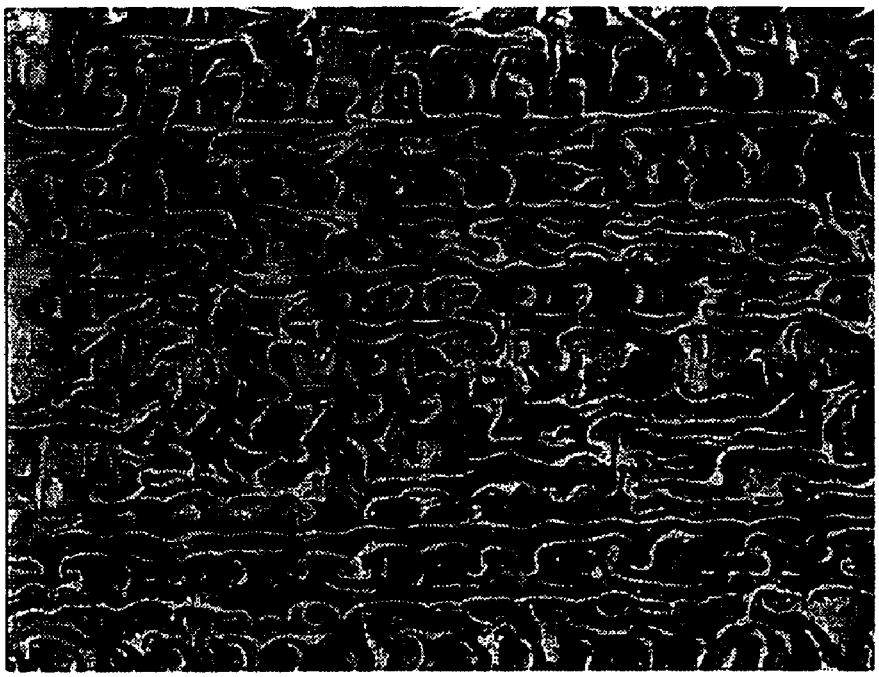
FIG. 6 is a micrograph of a receiving material printed with a hot melt ink solid surface using the pattern shown in FIG. 3.

FIG. 6 is a micrograph of a receiving material printed with a hot melt ink solid surface using the pattern given in FIG. 3. Individual ink drops can still clearly be recognised in this micrograph but the ink drops appear to have run together practically entirely to varying degrees with their neighboring drops. This gives a silky gloss impression to the ink on the receiving material.

Figure 7:
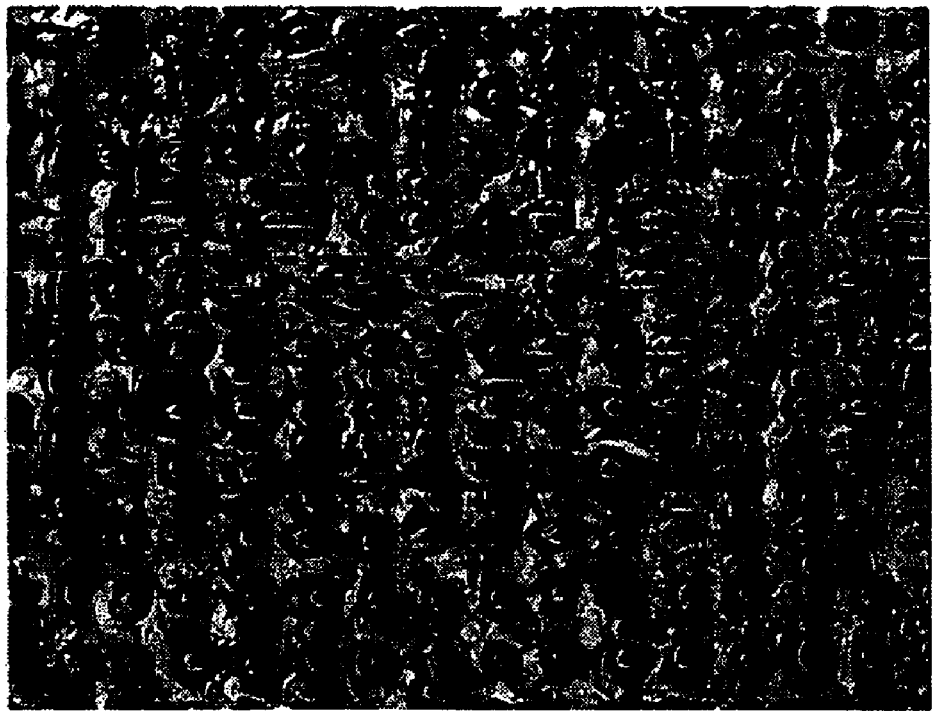
FIG. 7 is a micrograph of a receiving material printed with a hot melt ink solid surface using the pattern shown in FIG. 4.

FIG. 7 is a micrograph of a receiving material printed with a hot melt ink solid surface using the pattern given in FIG. 4. In this micrograph, practically all the ink drops can still be recognised as individual ink drops. This means that the ink drops have scarcely run together if at all, and instead they have solidified as individual ink drops. This results in a relatively rough ink surface which consequently scatters the light intensity so that a matt impression forms.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer provided with a printhead containing a number of print elements from which individual ink drops can be transferred to a receiving material in accordance with a print mask that provides a distribution strategy for the ink drops on the receiving material, whereby the printer can generate different print masks corresponding to different degrees of gloss, wherein the printer uses hot melt ink and also includes a selection means for the selection of a specific degree of gloss, on the basis of which selection a print mask can be generated that corresponds to the selected degree of gloss, such that for a different degree of gloss a different distribution strategy for placing the ink drops on the receiving material is utilized, said print mask being such that upon distributing the ink drops onto the receiving material in accordance with the corresponding distribution strategy, the ink acquires the said degree of gloss on the receiving material.

2. The printer according to claim 1, wherein the selection can be made by a user of the printer.

3. The printer according to claim 2, wherein the printer comprises a remote workstation, and the user makes the selection from the workstation.

4. The printer according to claim 1, wherein the selection can be made automatically by the printer on the basis of an adjustable criterion.

5. The printer according to claim 4, wherein the criterion is selected from any one of the receiving material, the type of hot melt ink, the type of information for printing, the user, and the maximum printing time.

6. The printer according to claim 5, wherein the automatic selection can be cancelled by the user of the printer.

7. A method of printing a receiving material with ink in accordance with a print mask that provides a distribution strategy for ink drops on the receiving material comprises:

pre-selecting a degree of gloss which the ink is required to acquire on the receiving material, on the basis of which selection a print mask can be generated that corresponds to the selected degree of gloss, such that for a different degree of gloss a different distribution strategy for placing the ink drops on the receiving material is utilized, generating different print masks with a printer corresponding to said different degrees of gloss, printing with hot melt ink using a printer provided with a printhead having a number of print elements, wherein individual ink drops are jetted from the print elements and transferred to the receiving material in accordance with the corresponding distribution strategy which provides a distribution pattern for the ink drops on the receiving material, whereafter the ink solidifies on the receiving material and acquires the selected degree of gloss.

8. The method of claim 7, wherein print patterns corresponding to the print masks are stored in memory, and by the selection of the desired degrees of gloss, the patterns are selectively retrieved from said memory.

* * * * *